US005960798A

United States Patent [19]

Jenkins et al.

[11] Patent Number: 5,960,798

[45] Date of Patent: Oct. 5, 1999

[54] METHOD AND APPARATUS FOR CREATING ART ON AN OBJECT SUCH AS A PERSON'S FINGERNAIL OR TOENAIL

[75] Inventors: Nevin C. Jenkins; Rande W. Newberry, both of Homosassa, Fla.; William P. McVay, Doylestown, Pa.

[73] Assignee: Fashion Nails, Inc., Homosassa, Fla.

[21] Appl. No.: 09/030,947

[22] Filed: Feb. 26, 1998

[51] Int. Cl.[6] ..... A45D 29/00

[52] U.S. Cl. ..... 132/73

[58] Field of Search ..... 132/73, 285; 101/33, 101/163, 166, 193, 41

[56] References Cited

U.S. PATENT DOCUMENTS

| | | | |
|---|---|---|---|
| Re. 14,619 | 3/1919 | Moeller . | |
| 310,784 | 1/1885 | Bollinger . | |
| 1,594,431 | 8/1926 | Thomson . | |
| 1,728,512 | 9/1929 | Sharp . | |
| 2,031,225 | 2/1936 | O'Donnell . | |
| 2,180,519 | 11/1939 | Hamilton et al. . | |
| 2,220,758 | 11/1940 | Florio . | |
| 2,245,929 | 6/1941 | Mangold . | |
| 2,246,729 | 6/1941 | Gutberlet . | |
| 2,262,977 | 11/1941 | Vasil . | |
| 2,287,062 | 6/1942 | Powers et al. . | |
| 2,296,795 | 9/1942 | Landsman . | |
| 2,454,004 | 11/1948 | Pettyjohn . | |
| 2,485,384 | 10/1949 | Klein . | |
| 2,519,335 | 8/1950 | Ballou et al. . | |
| 2,524,322 | 10/1950 | Lipnicki et al. | 132/285 |
| 2,580,893 | 1/1952 | Dee . | |
| 2,701,520 | 2/1955 | Rider | 101/163 |
| 2,735,435 | 2/1956 | Feinstein . | |
| 2,799,282 | 7/1957 | Slack . | |
| 2,842,046 | 7/1958 | Murray . | |
| 3,070,906 | 1/1963 | Tinsley . | |
| 3,094,920 | 6/1963 | Priesmeyer . | |
| 3,164,259 | 1/1965 | De'Caccia . | |
| 3,461,885 | 8/1969 | Coveney . | |
| 3,480,020 | 11/1969 | Ernest . | |
| 3,515,154 | 6/1970 | Morgese . | |
| 3,598,685 | 8/1971 | Lee et al. | 132/73 |
| 3,898,357 | 8/1975 | Miller et al. . | |
| 3,916,784 | 11/1975 | Dubuit . | |
| 4,019,436 | 4/1977 | Handweiler et al. . | |
| 4,060,031 | 11/1977 | Philipp . | |
| 4,314,504 | 2/1982 | Combeau . | |
| 4,508,032 | 4/1985 | Philipp . | |
| 4,738,199 | 4/1988 | Chen . | |
| 4,803,922 | 2/1989 | Dennesen | 101/41 |
| 4,915,239 | 4/1990 | Persch . | |
| 4,968,253 | 11/1990 | Thomas . | |
| 5,090,320 | 2/1992 | Nave | 101/41 |
| 5,133,369 | 7/1992 | Billings | 132/73 |
| 5,151,386 | 9/1992 | Bottari et al. . | |
| 5,269,330 | 12/1993 | Hayes | 132/73 |
| 5,277,205 | 1/1994 | Jenkins . | |
| 5,302,224 | 4/1994 | Jenkins et al. | 101/163 |
| 5,316,026 | 5/1994 | Jenkins | 132/285 |
| 5,743,180 | 4/1998 | Arnke . | |

*Primary Examiner*—Todd E. Manahan
*Attorney, Agent, or Firm*—Evenson, McKeown, Edwards & Lenahan, P.L.L.C.

[57] ABSTRACT

A hand-operated apparatus for applying an image on a person's fingernail consisting of a base having an upper surface defining a first cutout. A stop is provided to establish a reference point. An image creating plate is received in the first cutout for creating an image composed of an image defining coating material. A digit positioning member having a V-shaped groove receives and positions a person's digit relative to the location of the created image. An orientation surface is defined by the base against which the free end of the person's digit bears to establish, in cooperation with the V-shaped groove, the appropriate orientation relative to the reference point. A transfer member is mounted on the base movable over the upper surface for transferring the created image from the image creating plate to the person's nail. A method for applying an art image on a person's nail in which a reference point is established. A person's digit is positioned in a V-shaped groove with the free end of the digit bearing against an orientation surface, located relative to the reference point. A supporting base provides a first preselected location. An image composed of an image defining coating material is created at a location remote from the first preselected location. The created image is picked up from said remote location by a transfer element and transferred to the person's nail.

18 Claims, 8 Drawing Sheets

METHOD AND APPARATUS FOR CREATING ART ON AN OBJECT SUCH AS A PERSON'S FINGERNAIL OR TOENAIL

FIELD OF INVENTION

The present invention relates to a method and apparatus for creating art on an object, and more particularly, relates to a method and hand operated apparatus for creating an art image on an object, such as, a fingernail or toenail of a person's digit.

BACKGROUND OF THE INVENTION (a) Prior Art

The desirability of creating art images on a person's fingernails and toenails is widely recognized and practiced. Known techniques include transfers, decals, appliques and hand painting. Recently, U.S. Pat. Nos. 5,277,205; 5,302,224; and 5,316,026 have been granted regarding novel techniques for creating images on nails. Although the new technology works well in principle, there remains a need to further develop the technology in order to advance it to the point where complex multicolor images can be created consistently and repeatably with excellent registration and detail. Also, there remains a need to improve and engineer the known apparatus to enable manufacture both efficiently and economically.

(b) Summary of Invention

Therefore, the principal object of the present invention is to provide a method and apparatus for effectively creating nail art on the nail of a person's digit, and to do so to accomplish the noted purposes. To this end, the invention provides hand-operated apparatus that can be manufactured efficiently and readily, and that will be of rugged construction and will function effectively, smoothly and repeatably.

Accordingly, the present invention achieves the principal object of the invention by a method for applying an art image on a person's nail that comprises the steps of establishing a reference point, positioning a person's digit in a V-shaped groove with the free end of the digit bearing against an orientation surface, located relative to the reference point, on a supporting base at a first preselected location, creating an image composed of an image defining coating material at a location remote from the first preselected location, picking up the created image from said remote location by a transfer element movably mounted on the supporting base, transferring the picked up image over the surface of the supporting base to the person's nail at said first preselected location, and depositing the picked up image onto the person's nail at a position on the nail correlated with the reference point.

In the method the picked up image may be transferred by a linear motion. Also, the depositing of the picked up image may be effected by a linear motion. Further, the transfer of the picked up image may be effected with guiding. The step of creating the image may include the steps of depositing coating material onto the plate and doctoring excess coating material in the creation of the image. The method steps can be repeated a multiple of times with repositioning of the plate between successive times. The method can further include a step of positively stopping the picked up created image in proper orientation to the person's nail during transfer, and the stopping can be adjustable. The method can be carried out to create a multi-color image.

The present invention additionally contemplates a hand operated self-contained apparatus for applying an image on a person's nail comprising a base having an upper extending surface defining a first cutout, an element for establishing a reference point, an image creating plate received in said first cutout for creating thereon an image composed of an image defining coating material, a digit positioning member having a V-shaped groove for receiving and positioning a person's digit relative to the location of the created image, an orientation surface defined by the base against which the free end of the person's digit bears to establish, in cooperation with the V-shaped groove, the appropriate orientation relative to the reference point, a transfer member mounted on said base movable over the upper surface for transferring the created image from the image creating plate to the person's nail.

The apparatus may further be characterized in that the transfer member includes a squeegee for removing excess coating material from an image and a pick up pad for picking up a created image. The apparatus can further include guide elements to guide the transfer member during movement, and the guiding can be linear. In the apparatus the squeegee and the pick up pad may be mounted in common, with the pad mounted for vertical movement. The apparatus may further comprise an adjustable stop serving as the reference point for indexing the pick up pad relative to the person's nail. Also, the apparatus may have the digit positioning member removably positioned in a second cutout in the base and spring biased upwardly.

Other objects and advantages of the present invention will become readily apparent from the following.

BRIEF DESCRIPTION TO THE DRAWINGS

DESCRIPTION OF PREFERRED EMBODIMENTS

Figure 1:
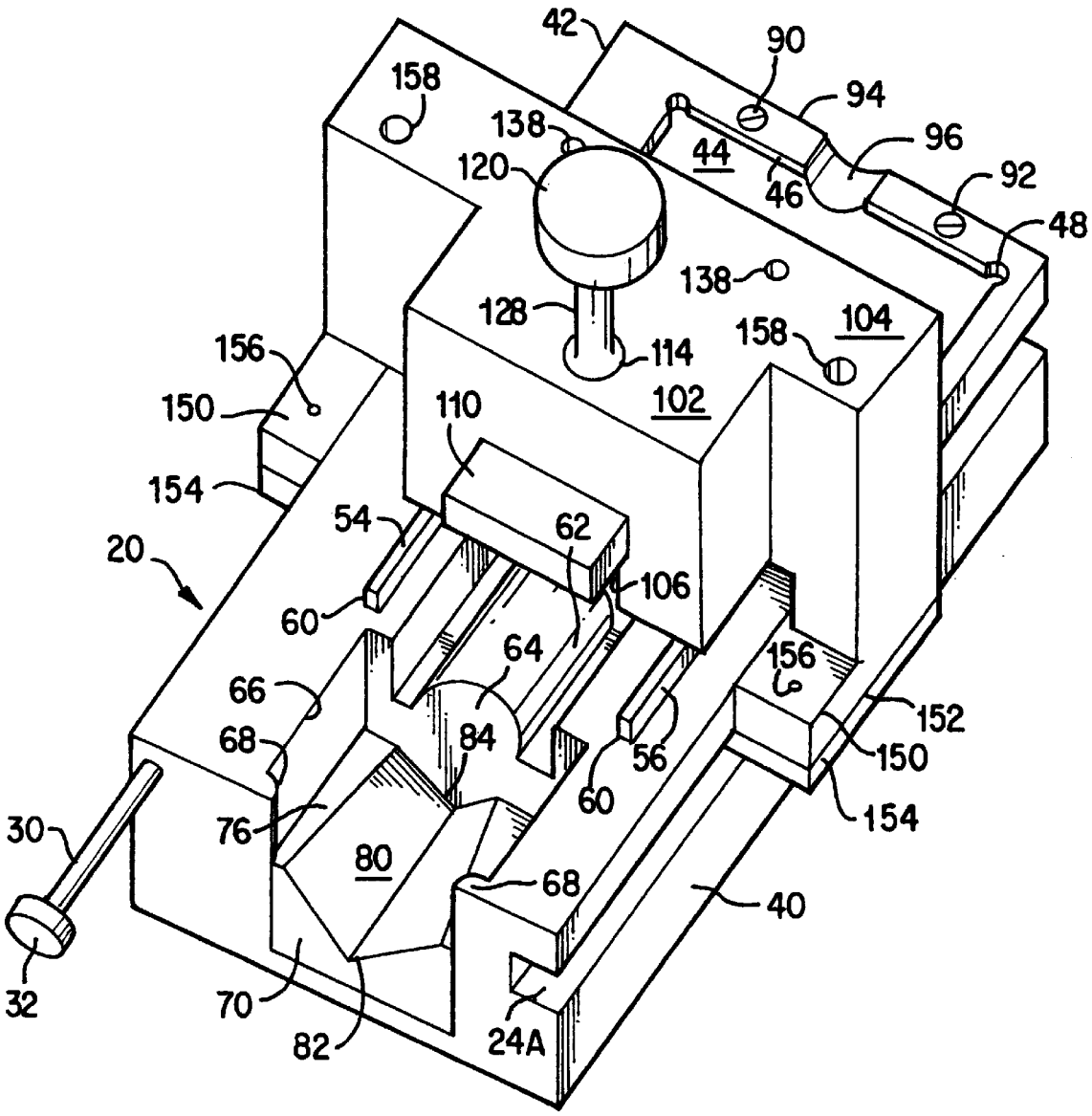
FIG. 1 is a perspective view of the apparatus of the present invention.
Figure 2:
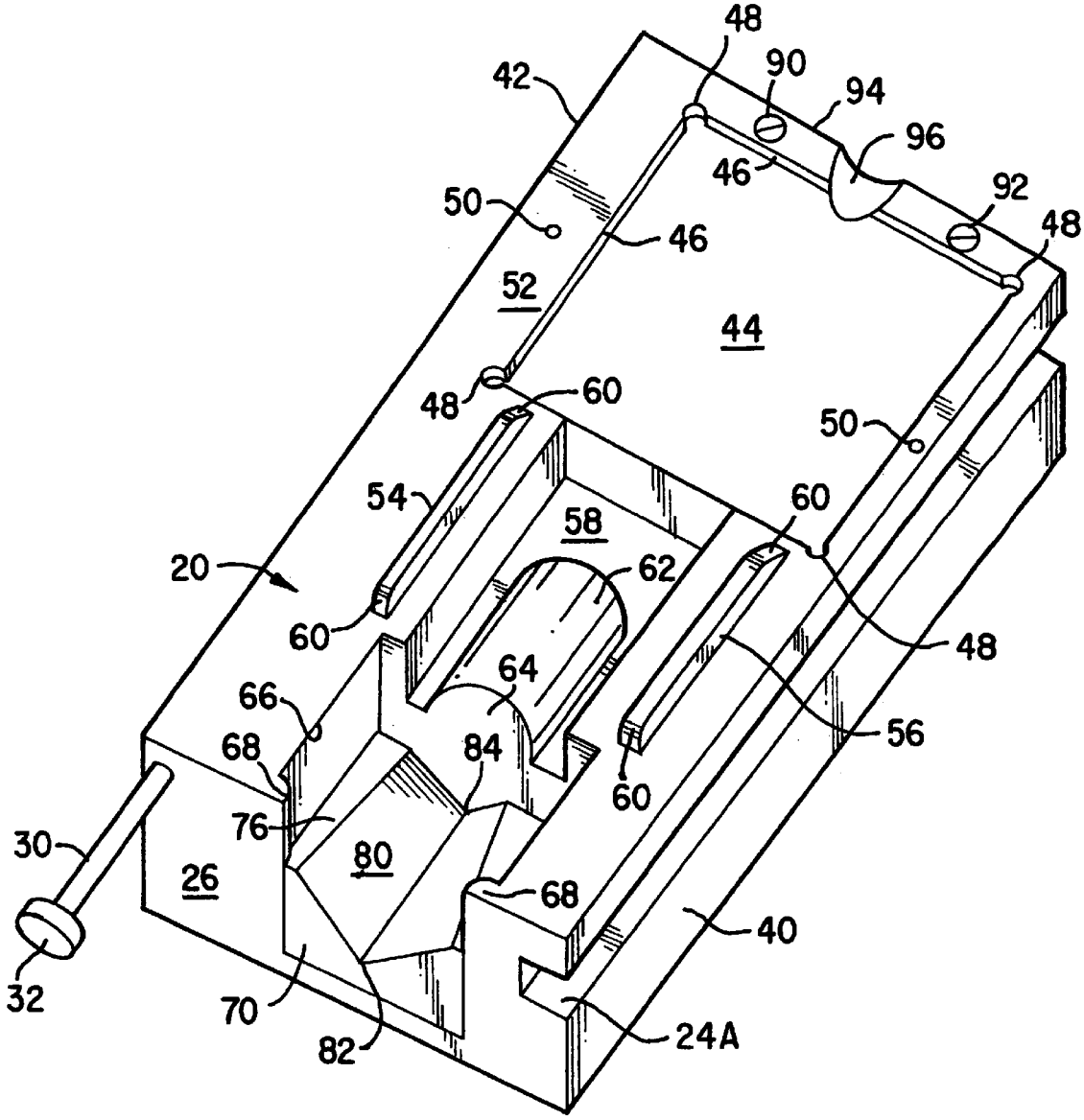
FIG. 2 is a perspective of the base block of the apparatus shown in FIG. 1.
Figure 3:
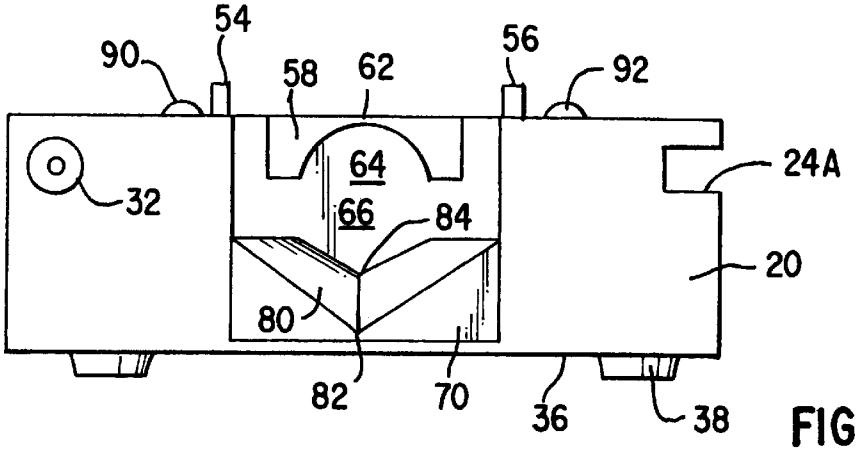
FIG. 3 is an end elevation showing the front of the base block.
Figure 4:
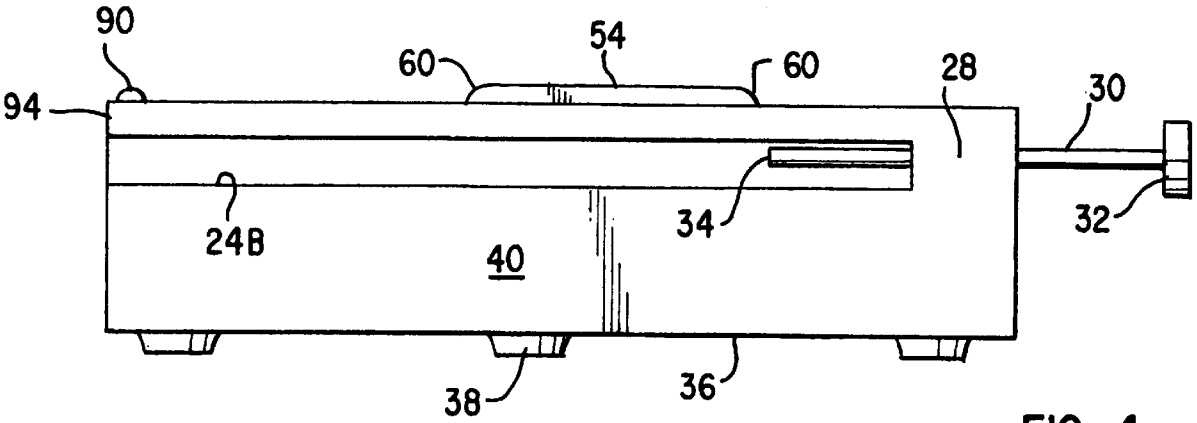
FIG. 4 is a side elevation of the base block.
Figure 5:
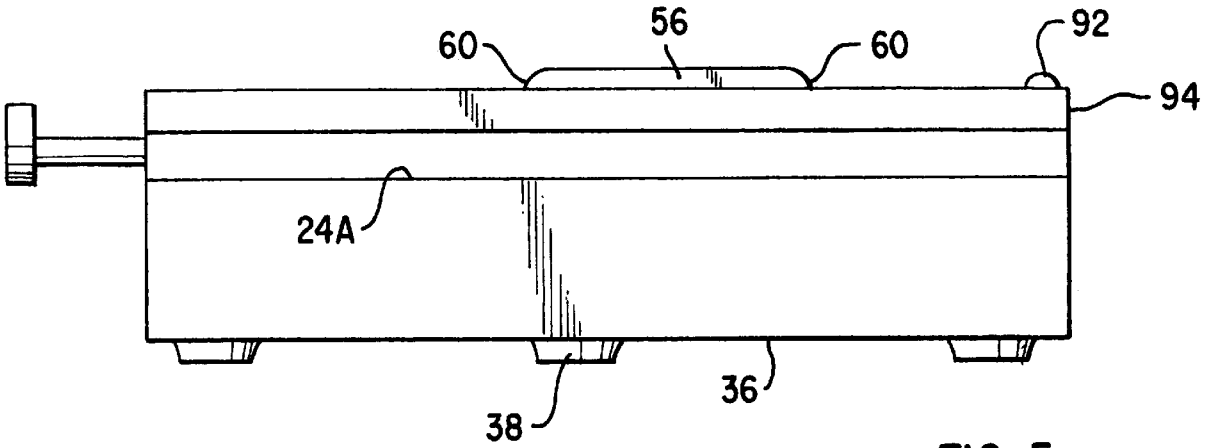
FIG. 5 is a side elevation of the base block showing the opposite side.
Figure 6:
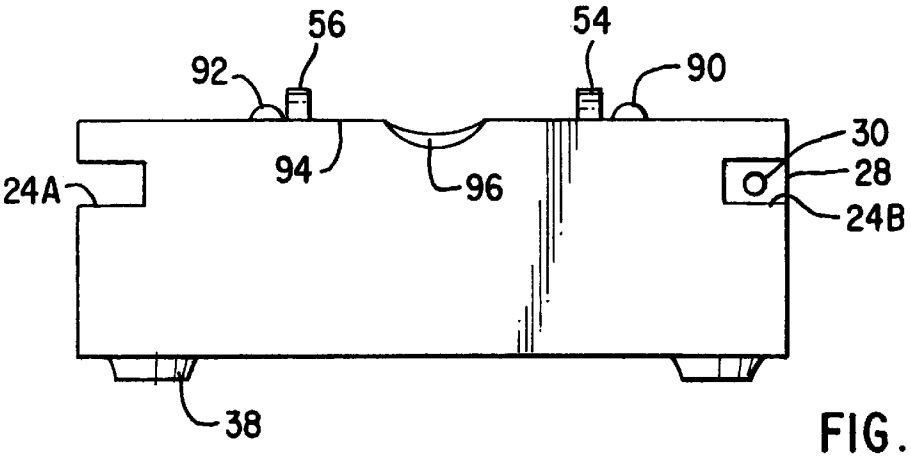
FIG. 6 is an end elevation showing the rear of the base block.
Figure 7:
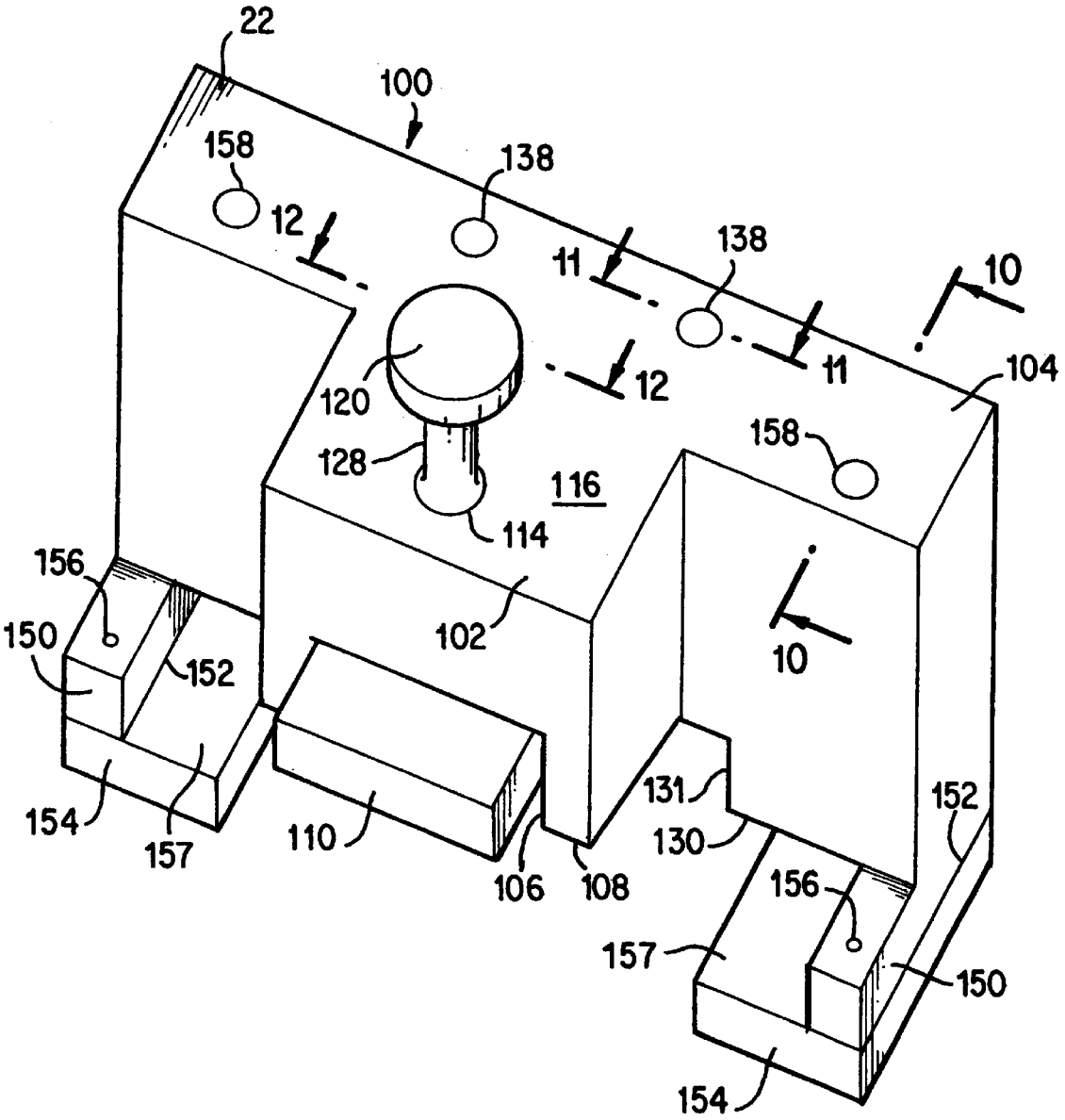
FIG. 7 is a perspective view of the carriage block shown in FIG. 1.
Figure 8:
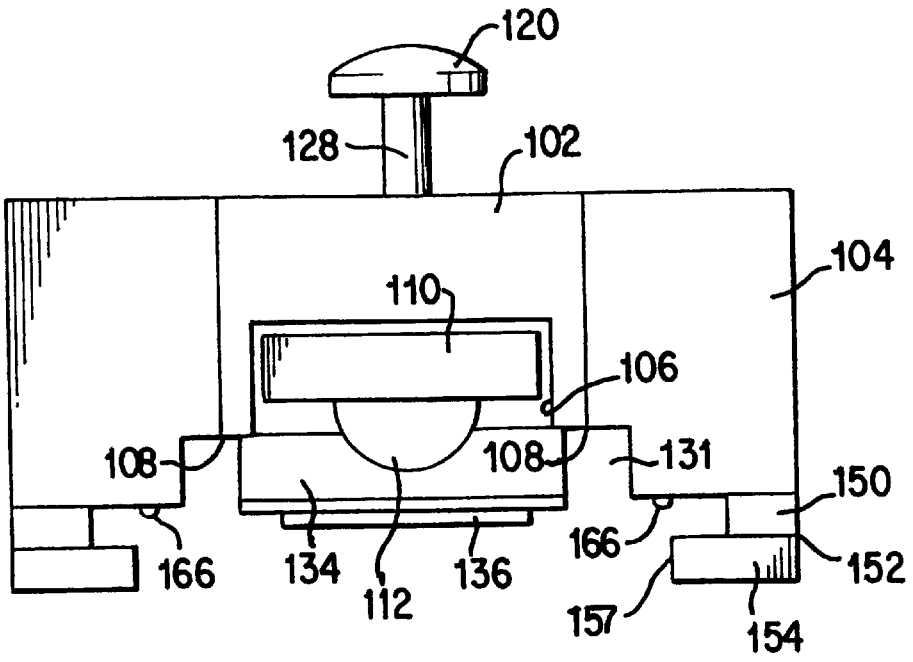
FIG. 8 is a front elevation of the carriage block.
Figure 9:
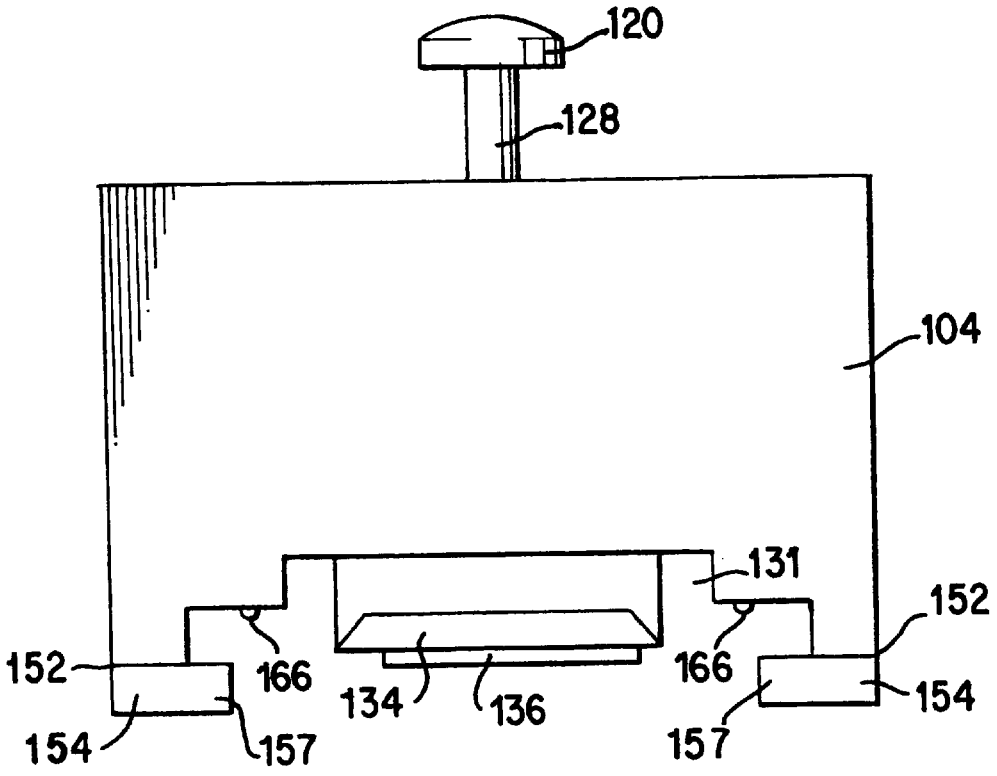
FIG. 9 is a rear elevation of the carriage block.

Referring now to the drawings in detail, the apparatus of the present invention, as shown in the drawings, consists of a base block 20 on which is mounted a carriage block 22 in sliding relationship. Referring in particular to FIGS. 1 to 6, the base block 20 is characterized by a rectangular parallelepiped block. Block 20 has longitudinally extending grooves 24*a* and 24*b* formed in the opposite sides 40 of block 20. The grooves 24*a* and 24*b* extend parallel to the sides 40 of the block 20 and are inset or recessed normal into the side surfaces 40. One groove 24*a* extends the length of its respective side 40, and the other groove 24*b* terminates short of the front 26 of the block. A web 28 is defined and is provided with a through hole through which a long screw 30 threadedly extends, with its head 32 projecting out the front of the block. The other end 34 of screw 30 extends into the groove 24*b*. Screw 30 provides a stop to align the impression of an image onto a nail, as will be explained in more detail hereinafter. The bottom 36 of block 20 is provided with six rubber feet 38 in order to improve traction on a supporting surface and prevent slippage.

The rear end 42 of block 20 is recessed at 44 to define an area to receive an etched or engraved plate upon which images are created. The recess 44 is planar with shallow sides 46. The corners of the recess are cutout with small circular areas 48 to facilitate insertion and removal of the plates. Small recesses 50 are defined in the upper surface 52 of the block 20 on opposite sides of the recess 44 for the purpose of aligning the carriage block 22 upon image pick-up. Forward of the recess 44 are two guide rails 54 and 56 which extend in parallel longitudinally of the block 20, and are spaced apart a distance less than the width of the recess 44 so that the rails lie within the lateral profile of the recess 44. Between the rails is formed a recess 58 which extends into the block 20 and longitudinally. The rails 54 and 56 project perpendicularly to the upper surface 52 of the block 20 and are rounded at their leading and trailing ends as indicated at 60. Set into the recess 58, at its forward end, is a rounded projection 62 in the shape of half a right cylinder with its forward flat surface 64 extending transversely to the block 20. At the front of the block 20 is a deep recess 66 which lies directly in front of the flat surface 64. The top of the projection 62 lies substantially in the plane of the upper surface 52. The forward end of the recess 66 defines projecting bars 68 to partially restrict the opening of the recess 66.

Figure 13:
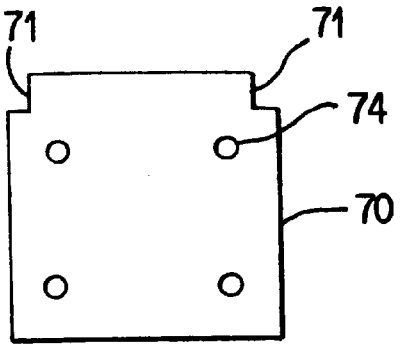
FIG. 13 is a bottom view of the finger holding block.
Figure 10:
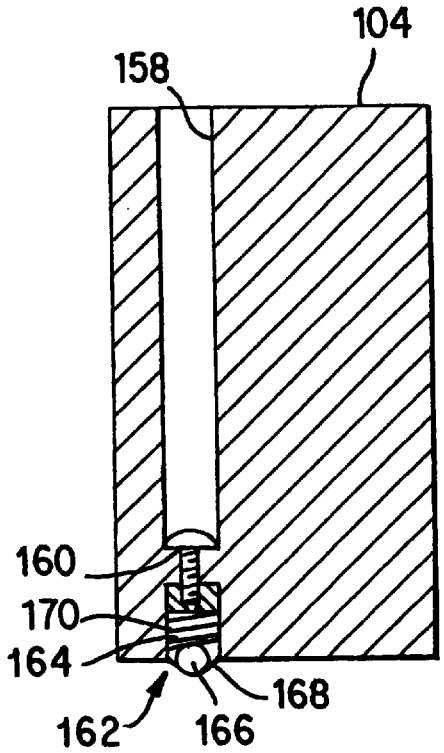
FIG. 10 is a section of the carriage block taken along line 10—10.
Figure 11:
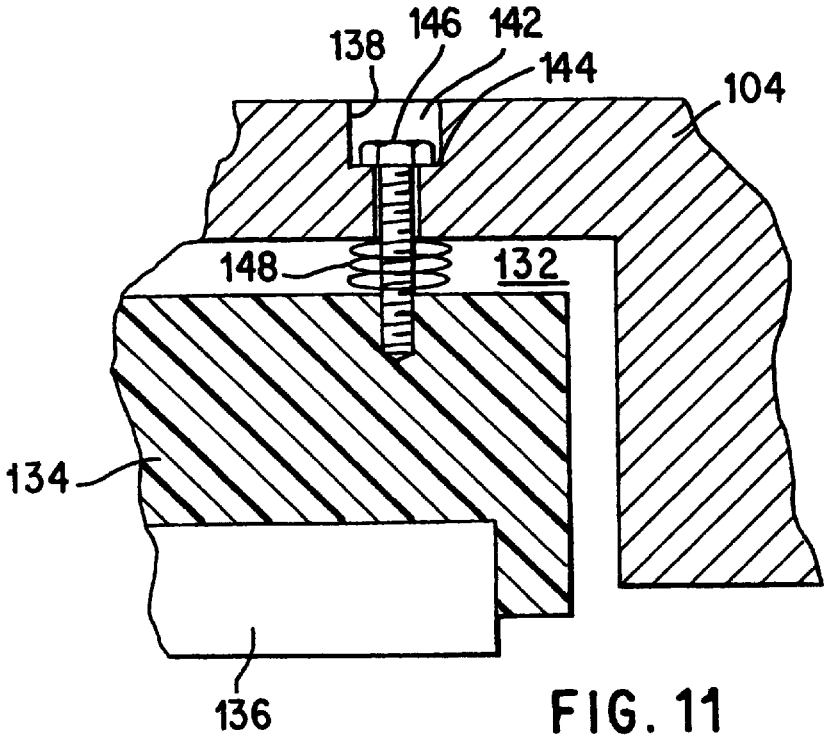
FIG. 11 is a section taken along line 11—11.
Figure 12:
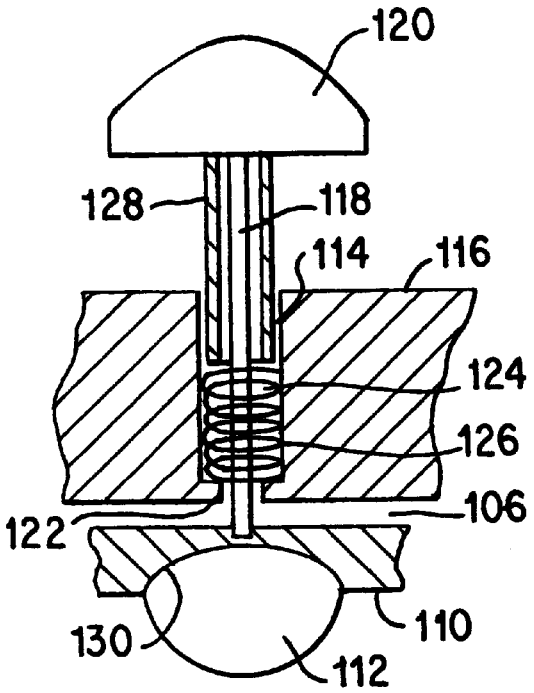
FIG. 12 is a section taken along line 12—12.

Received in the recess 66 is a finger block 70. The bottom surface 72 of the block 70 has four holes or recesses 74 spaced about the bottom surface. These are best seen in FIG. 13. Coil springs (not shown) are received in the recesses 74 and lie between the bottom surface of the block 70 and the bottom surface of the recess 66. The forward portion of block 70 defines vertical grooves 71 on opposite sides. Bars 68 are received in grooves 71 when block 70 is positioned in recess 66 and trap the block 70 in recess 66 and prevent any longitudinal movement between the block 70 and the block 20. However, it is possible to remove the block 70 by lifting upwardly with respect to the block 20. The springs provide flexibility and adjustment vertically to accommodate fingers of different size. The upper surface 76 of block 70 is provided with a V-shaped groove 80 which angles upwardly from front to back. Therefore, the V is cut deeper in the front at 82 than in the back at 84. The purpose of the block 70 is to receive a finger so that the end of the nail just overlies the projection 62 at it front face 64 with the end of the finger contacting the surface 64. The V-shape also helps to accommodate fingers of different size.

The rear of block 20 is provided with two upwardly projecting stops 90 and 92 which serve to stop the carriage block 22 as will become evident. The stops are located on the rear edge of the block 20 generally aligned with the rails 54 and 56. Between the stops 90 and 92, the rear edge 94 of block 20 is cut out at 96 to enable a person to insert a finger or a suitable tool into the recess 44 beneath a plate located in the recess for the purpose of repositioning the plate.

The carriage block 22 is shown in FIGS. 1 and 7 to 12 and consists of a main block 100 having a T-shape. Leg 102 of the T extends in the longitudinal direction and the crossbar 22 of the T extends in the transverse direction with respect to movement of travel of the carriage block. The leg 102 defines a cutout 106 at its lower front edge 108 into which is received a square block 110 which serves as a holder for pad 112. Block 110 defines a recess 130 in its lower surface into which is force fit pad 112. Leg 102 also defines a through hole 114 which extends vertically from the top surface 116 to the recess or cutout 106. A threaded bolt 118 extends through hole 114 and projects above the top surface 116 of the leg 102. Bolt 118 is threaded into a threaded bore in the top of square block 110 and attached to it in this manner. A knob 120 is fixed to the top of bolt 118. The throughbore 114 is narrowed at its lower end by lip or inwardly directed flange 122, and this defines an enlarged annular portion 124 into which is located a coil spring 126. A sleeve 128 surrounds bolt 118 and is fixed to the under surface of the knob 120 and extends into the hole 114 where it contacts the spring 126. The spring 126 is caught between the lip 122 and the lower end of the sleeve 128 normally biasing the bolt 118 upwardly.

The crossbar 104 is a generally rectangular block that has a U-shaped cut out 131 in its lower surface 130. Also, the crossbar defines a rectangular recess 132 which extends vertically upwardly into crossbar 104 from the U-shaped recess 131, see FIG. 11. Received in the recess 132 is a vertically oriented doctor carrying plate 134 in which is embedded a doctor blade 136 which projects out of the bottom of plate 134, also vertically oriented. Plate 134 is composed of a suitable plastic material and blade 136 is composed of steel. A pair of bores 138 are drilled into the top of crossbar 104 within the profile of the T-bar 102 and extend into the recess 132. The upper part of each bore 138 is enlarged at 142 to define a shoulder 144 at the lower end of the enlarged portion of the bore. A bolt 146 is received into each bore 138 and extends into the recess 140 where it is fixed to the top of the plate 134, such as, by being threaded or screwed into a threaded hole in the plate. The head of the bolt 146 bears against the shoulder 144. A coil spring 148 surrounds each bolt 146 and normally biases the plate 134 downwardly.

The bottom side edges 152 of the crossbar 104 are characterized by forwardly extending longitudinal projections 150 to elongate the bottom side edges. Attached to the bottom edges 152 are plastic slides or glides 154, the attachment being effected by rivets 156 or any other suitable fasteners. The slides 154 extend longitudinally beneath the sides of the crossbar 104 and also extend inwardly to provide slide rails 157 which are received in the grooves 24*a* and 24*b* of the block 20 as shown in FIG. 1.

Holes 158 are formed in crossbar 104 and extend downwardly through the crossbar opening at the bottom above the slide rails. The holes are formed from the top and bottom to define a lip or shoulder 160 near the bottom. A detent mechanism 162 is received in the lower portion of each of the holes 158 with it detent slightly projecting from the bottom of the crossbar 104. In the drawing, the detent mechanism is shown in detail in FIG. 10 and consists of a housing 164 in which is positioned a ball detent 166 which is held in by lips 168. A coil spring 170 located in the housing above the ball normally biases the ball downwardly. A bolt 172 is positioned in the upper portion of the hole 158 and protrudes downwardly through the shoulder 160 and is fastened to the housing of the detent mechanism. The detent mechanisms are aligned longitudinally and transversely with the recesses 50 which are defined on the upper surface of the block 20 on opposite sides of the plate receiving recess 44.

Figure 14:
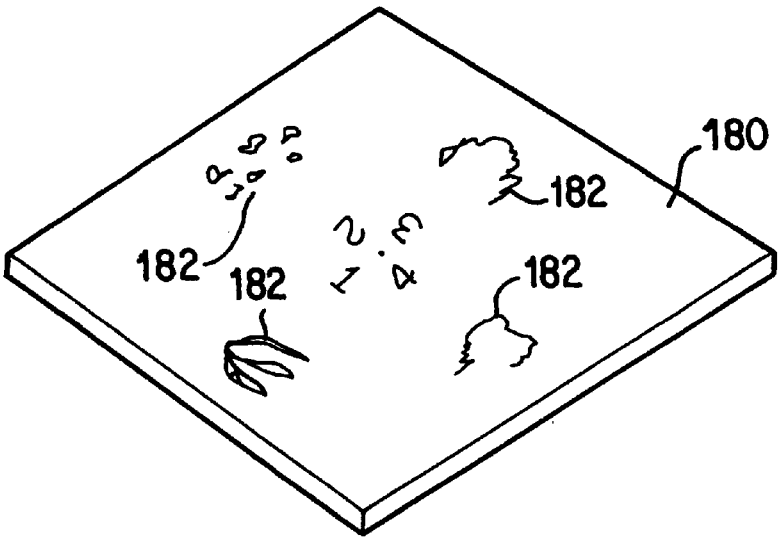
FIG. 14 is a plan view of a plate containing images that is used with the apparatus of the present invention.

A typical plate for use with the hand operated apparatus of the present invention is shown in FIG. 14. The plate 180 is composed of steel and is thin to fit into the recess 44. Etched or engraved into the plate are a series of four images 182 which can comprise four different one color images or a lesser combination of multicolor images. For example, the plate can contain one three color image and one one color image, two two color images, or one four color image. The individual etchings, numbered 1 to 4 on the plate, can constitute collectively a four part image, two two part images, one three part image and a single image or four single images. As noted above, the parts of an image collectively form an integrated or whole image. The advantage of having the image in parts is that four different colors can be used, one for each part. Thus, in the arrangement as described, it is possible to create a four color image on the nail.

The operation of the apparatus for the creation of a four color image is as follows. The carriage block 22 is placed in a middle or neutral position exposing recess 44. A person inserts a finger into the V-groove 80 with the pad at the end of the finger gently pressing against surface 64 and the forward end of the nail positioned to overlie hemi-cylindrical projection 62. In this position the block 134 and doctor blade 136 are elevated off the surface of block 20 because the block 134 is engaging and riding on rails 54 and 56 which engage the lower edge of block 134 on opposite sides of blade 136. The stop 34 is adjusted and positioned by turning screw 30 so that carriage block 22 will stop so that pad 112 overlies the area of the nail onto which an image is to be placed. A plate is placed in recess 44 with image number 1 proximate the forward edge of recess 44. A small amount of a liquid coloring material, e.g. nail polish, is spread on plate 180 just in front of image number 1. The carriage block 22 is now pushed back until detents 166 engage recesses 50 whereupon the block 22 will be positioned such that pad 112 overlies image number 1. While block 22 is being moved rearwardly, the block 134 rides off the curved rear ends 60 of rails 54 and 56, and the doctor blade 136 is engaging the surface of the recess 44 under a spring force. Rearward movement of the block 22 results in the blade 136 doctoring off the excess nail polish as it continues to move rearward. The block moves rearwardly until the stops 90 and 92 are struck by the doctor blade holder 134. In this position, the pad 112 directly overlies the image containing the nail polish, and is in the correct position to pick-up the polish from the image. Depressing the knob 120 causes the pad 112 to engage the surface of the plate 180 and pick-up the polish in the pattern of the image on the plate. The block 22 is immediately pulled or reciprocated in the forward direction until rail 157 engages the end 34 of screw which is acting as a stop. In this position, the pad 112 directly overlies the fingernail located in the groove 80 whereupon depression of the knob 120 will transfer the polish image to the fingernail. During movement of the block 22 in the forward direction the doctor holding plate 134 rides up onto the rails 54 and 56 removing it from the surface of block 20. The steps recited above are repeated for each image on the plate 180. Between steps, the plate 180 is rotated 90 degrees by inserting a finger under the plate 180 via cutout 96, lifting the plate 180 out of the recess 44 and repositioning in the recess 44.

The blocks 20 and 22 may be made of metal or plastic or combinations thereof. As already noted the plate 180 is preferably made of steel and engraved or etched by any suitable process to create the recesses to effect the image of coating material.

Although the invention has been described in terms of a specific preferred embodiment, nevertheless changes and modifications are possible that will be evident to a person skilled in the art. Such changes and modifications are deemed to come within the purview of the invention as recited in the appended claims.

What is claimed is:

1. A method for applying an art image on a person's nail comprising the steps of establishing a reference point, positioning a person's digit in a V-shaped groove with the free end of the digit bearing against an orientation surface and with the digit nail overlying the orientation surface, located relative to the reference point, on a supporting base at a first preselected location, creating an image composed of an image defining coating material at a location remote from the first preselected location, picking up the created image from said remote location by a transfer element movably mounted on the supporting base, transferring the picked up image over the surface of the supporting base to the person's nail at said first preselected location, and depositing the picked up image onto the person's nail at a position on the nail correlated with the reference point.

2. A method according to claim 1 wherein the picked up image is transferred by a linear motion.

3. A method according to claim 2 wherein creating the image includes the steps of depositing coating material onto a plate in the vicinity of where the image is created and doctoring excess coating material away from where the image is created.

4. A method according to claim 1 including the step of guiding the transfer of the picked up image.

5. A method according to claim 1 wherein the depositing of the picked up image is effected by a linear motion.

6. A method according to claim 1 wherein the steps are repeated a multiple of times with presentation of a different image each time to obtain a multi-part image on the person's nail.

7. A method according to claim 6 wherein a different color image defining coating material is used each time.

8. A method according to claim 1 wherein the reference point is defined by a stop.

9. A method according to claim 8 wherein the positioning step includes the step of adjusting the stop.

10. A method according to claim 1 further including a step of positively stopping the picked up created image in proper orientation to the person's nail during transfer.

11. Hand-operated self-contained apparatus for applying an image on a nail of a person's digit comprising:

a base having an upper extending surface defining a first cutout, an element for establishing a reference point, an image creating plate received in said first cutout for creating thereon an image composed of an image defining coating material, a digit positioning member having a V-shaped groove for receiving and positioning a person's digit relative to the location of the created image, an orientation surface defined by the base against which the free end of the person's digit and the person's digit nail overlies to establish, in cooperation with the V-shaped groove, the appropriate orientation relative to the reference point, and a transfer member mounted on said base movable over the upper surface for transferring the created image from the image creating plate to the person's nail.

12. Apparatus according to claim 11 wherein said plate includes a plurality of images formed thereon.

13. Apparatus according to claim 11 wherein said transfer member includes a squeegee for removing excess coating material from an image and a pick up pad for picking up a created image.

14. Apparatus according to claim 13 wherein said squeegee and said pick up pad are mounted in common with the pad mounted for vertical movement.

15. Apparatus according to claim 11 wherein said transfer member is guided linearly during movement.

16. Apparatus according to claim 11 further including guide elements to guide said transfer member during movement.

17. Apparatus according to claim 11 further comprising an adjustable stop serving as the reference point for indexing said pick up pad relative to the person's nail.

18. Apparatus according to claim 11 wherein the digit positioning member is removably positioned in a second cutout in the base and spring biased upwardly.

* * * * *